US006322029B1

(12) United States Patent
Sonnenberg et al.

(10) Patent No.: US 6,322,029 B1
(45) Date of Patent: Nov. 27, 2001

(54) INSTALLATION BRACKET

(75) Inventors: Marko Henry Sonnenberg, Vastra Frolunda; Jovo Ilic, Alingsas, both of (SE)

(73) Assignee: Hunter Douglas Industries B.V. (NL)

( * ) Notice: Subject to any disclaimer, the term of this patent is extended or adjusted under 35 U.S.C. 154(b) by 0 days.

(21) Appl. No.: 09/499,541

(22) Filed: Feb. 7, 2000

(30) Foreign Application Priority Data

May 2, 1999 (EP) ..... 99200328

(51) Int. Cl.[7] ..... A47H 1/14

(52) U.S. Cl. ..... 248/222.13; 248/201; 248/261; 248/544; 248/251; 248/267

(58) Field of Search ..... 248/222.13, 201.261, 248/252, 544, 251, 254, 257, 267, 269

(56) References Cited

U.S. PATENT DOCUMENTS

| | | | | |
|---|---|---|---|---|
| 2,698,727 | | 1/1955 | Rutledge | 248/264 |
| 3,169,006 | * | 2/1965 | Lorentzen et al. | 248/262 |
| 4,235,406 | | 11/1980 | Vecchiarelli | 248/251 |
| 4,406,435 | * | 9/1983 | Anderson | 248/261 |
| 4,607,818 | | 8/1986 | Georgopoulos | 248/544 |
| 4,647,488 | | 3/1987 | Schnebly et al. | 428/116 |
| 4,802,644 | * | 2/1989 | Oskam | 248/251 |
| 4,919,185 | * | 4/1990 | Comeau et al. | 160/178.1 |
| 4,949,926 | * | 8/1990 | Liu | 248/251 |
| 5,060,710 | | 10/1991 | Haarer | 160/178.1 |
| 5,074,350 | * | 12/1991 | Carter | 160/178.1 |
| 5,180,130 | * | 1/1993 | McMichael | 248/251 |
| 5,195,570 | * | 3/1993 | Marocco | 160/178.1 |
| 5,230,493 | * | 7/1993 | Luoto | 248/251 |
| 5,353,857 | | 10/1994 | Anderson | 160/178.1 |
| 5,533,560 | * | 7/1996 | Morris | 160/178.1 |
| 5,667,178 | * | 9/1997 | Yang | 248/262 |

FOREIGN PATENT DOCUMENTS

| | | |
|---|---|---|
| 260814 | 4/1960 | (DE) . |
| 659487 | 10/1951 | (GB) . |
| 1014927 | 12/1965 | (GB) . |
| 2200531 | 8/1988 | (GB) . |

* cited by examiner

*Primary Examiner*—Leslie A Braun
*Assistant Examiner*—S Marsh
(74) *Attorney, Agent, or Firm*—Dorsey & Whitney LLP

(57) ABSTRACT

An installation bracket includes a generally L-shaped main body with a top wall, a rear wall, a supporting leg on the top wall for receiving a front rim of a head rail, a projection extending forwardly from the rear wall substantially parallel to the top wall, and a locking member pivotally mounted on the forward projection to swivel in a plane substantially parallel to the top wall between a first position juxtaposed to the rear wall and a second position perpendicular to the rear wall.

17 Claims, 4 Drawing Sheets

INSTALLATION BRACKET

This invention relates to an installation bracket for releasably mounting on a wall or ceiling, a head rail of an architectural covering, especially a covering for an architectural opening, such as a window blind or shade.

Different types of installation brackets have been proposed for this purpose. Usually such brackets have been positioned adjacent the ends of the head rail and, depending upon the length of the head rail, one or more brackets have also been located at intermediate positions along the length of the head rail.

U.S. Pat. No. 2,698,727 shows one form of bracket with an L-shaped main body which is securable to a wall or ceiling. The body has a top wall, a rear wall, and a supporting leg on a forward end of the top wall for receiving a front rim of a head rail. A locking member on the bracket is movable between a first or open position, in which the head rail can be position on, and removed from, the bracket, and a second or closed position, in which the head rail is locked in position on the bracket.

While mounting a head rail on such brackets. the movement of the locking members from the first position to the second position has not always been easy and sure. Also, such locking members have frequently been moved between the first and second positions by person who wanted to remove the head rails of blinds from their brackets or replace the head rails of blinds on their brackets but who were not skilled in installing and removing the head rails of blinds and had not themselves done the original installation of the head rails of blinds on the brackets. As a result, these unskilled persons have found it difficult to remove or replace the head rails of their blinds on such brackets. There has been a need, therefore, for a bracket with a locking member that is easier to open and close but provides secure fixation of the head rail.

In accordance with this invention, an installation bracket is provided, having a generally L-shaped main body with a top wall, a rear wall, a supporting leg on the top wall for receiving a front rim of a head rail, a projection extending forwardly form the rear wall, substantially parallel to the top wall, and a locking member pivotally mounted on the forward projection to swivel in a plane substantially parallel to the top wall between a first position juxtaposed to the rear wall and a second position perpendicular to the rear wall.

This installation bracket of this invention provides an easy and reliable means for securing a head rail in position on a wall or ceiling. The bracket is also very simple and easy to operate by even unskilled individuals.

Further aspects of the invention will be apparent from the detailed description below of a particular embodiment and the drawings thereof, in which.

Figure 1:
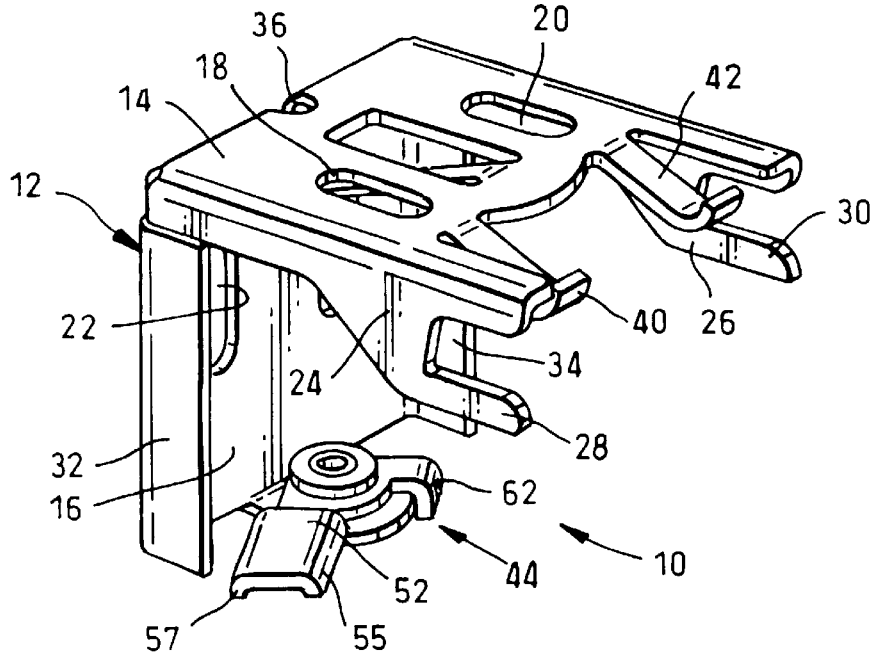
FIG. 1 is a perspective view of an installation bracket in accordance with this invention, viewed from above.
Figure 2:
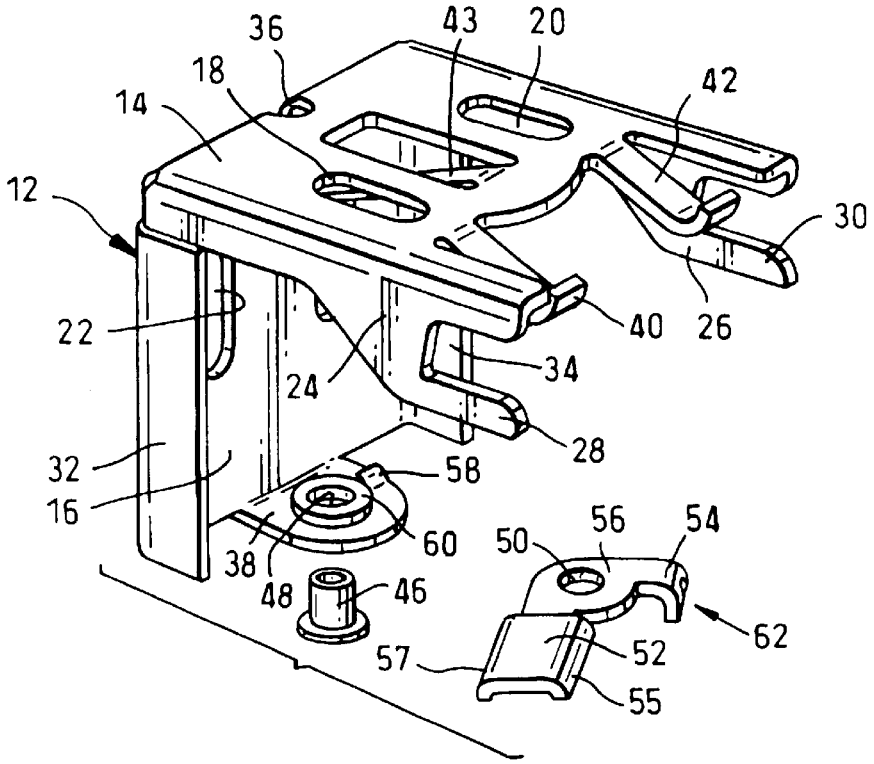
FIG. 2 is an exploded view of the bracket of FIG. 1 from a slightly different angle.
Figure 3:
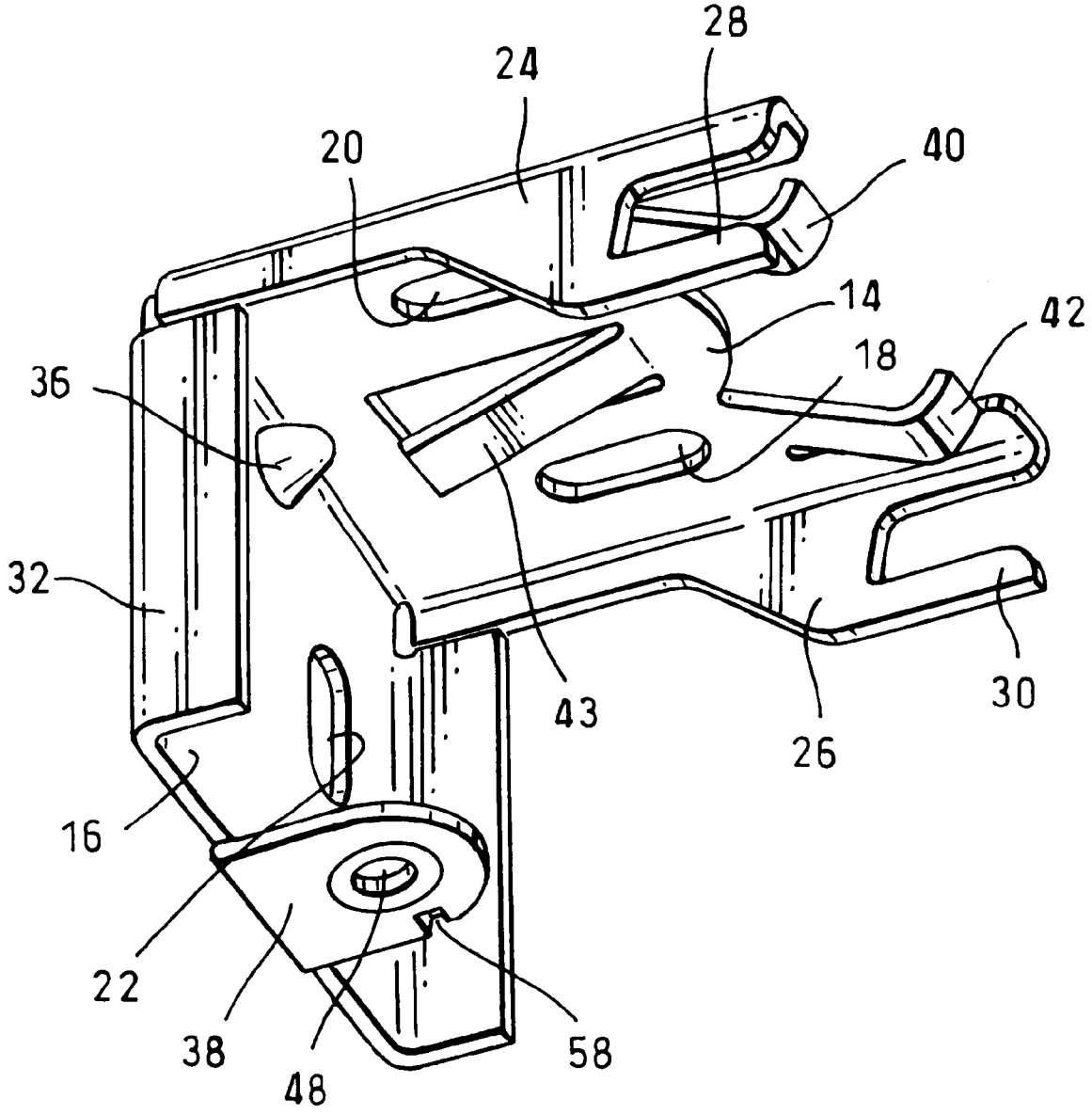
FIG. 3 is a perspective view from below of the main body of the bracket of FIG. 1.

FIGS. 1–3 show an installation bracket 10 of this invention. The bracket 10 includes a main body 12 of generally L-shape having a horizontal top wall 14 and a vertical rear wall 16. The top and rear walls 14, 16 are each provided with apertures 18, 20 and 22. respectively, for the passage of screws (not shown) to mount the bracket 10 on a horizontal and/or vertical building surface in a conventional manner. Along each of two opposite side edges of the top wall 14 are depending flanges 24, 26 which each carry an integrally formed, forwardly extending, supporting leg 28, 30, respectively. on a front end for the purpose of supporting a front rim of a head rail as described below.

The rear portion of each depending flange 24, 26 has a reduced height to provide room for accommodating a rear rim of head rail as also described below. The rear wall 16 has a forwardly extending, edge flange 32, 34 on each of its two opposite vertical side edges. The edge flanges 32, 34 are each adapted to abut against the bottom of the confronting reduced height rear portions of one of the depending flanges 24, 26. This arrangement ensures that the L-shaped main body 12 retains its shape under load-bearing conditions. Further shape stability of the main body 12 is achieved by a dimple 36 at the corner edge between the top wall 14 and the rear wall 16.

As best seen from FIG. 2, a projection 38 extends forwardly from the bottom of the rear wall 16 in a direction generally parallel to the top wall 14. In fact, the projection 38 can extend in a plane which is slightly angled in an upward direction, such as at an angle of about 5 degrees, to provide for a tighter fit of a head rail.

A pair of resilient, forwardly extending, press down arms 40, 42 are also provided on the front of the top wall 14. The press down arms 40, 42 are adapted to additionally press the head rail against the bracket. The effect of the press down arms 40, 42 on the forward rim of a head all will be explained below with reference to FIG. 5.

As best seen in FIGS. 2 and 3, the top wall 14 also has a downwardly and rearwardly extending, resilient tongue 43 with a free distal end spaced from the rear wall 16. The tongue is adapted to inwardly engage a rear rim of a head rail as described below with reference to FIGS. 4 and 5.

A swivel arm 44 is pivotally mounted on the projection 38 on the bottom of the rear wall 16 by means of a rivet 46. The rivet 46 engages the projection 38 and the swivel arm 44 through their corresponding apertures 48, 50, respectively.

The swivel arm 44 has a long arm 52 and a short arm 54, extending perpendicularly to one another and in a plane substantially parallel to the top wall 14, from a central body 56. The central body 56 also has the aperture 50 formed therein. The short arm 54 mainly assists in guiding the movement of the swivel arm 44 as it is swiveled from a first end position or open position, with the long arm 52 parallel to the rear wall 16, to a second end position or closed position with the long arm perpendicular to the rear wall 16. Conveneitently, the long arm 52 is provided with rounded edge portions, 55, 57 on its opposite, leading and trailing, longitudinal edges to assist it in being swiveled along a bottom surface of a head rail. In the second position of the swivel arm 44, the short arm 54 will be parallel to, and abut against, the rear wall 16, thereby inhibiting further pivotal movement of the swivel arm.

As also seen from FIGS. 2 and 3, the projection 38 on the bottom of the rear wall 16 is provided with an upwardly extending, raised detent 58. behind which the front edge of the short arm 54 snaps into the second position of the swivel arm 44. This raised detent 58 provides a positive indication when the swivel arm 44 is moved into its locked position. This positive indication of locking does not, however, significantly impede the locking or unlocking of the bracket since the short arm 44 can if desired, be readily moved over the detent, due to the inherent resiliency of the sheet metal, from which the bracket 10 and the swivel arm are preferably made. To reduce friction between the swivel arm 44 and the projection 38, the latter may also be provided with a raised annular portion 60. Surrounding the aperture 48 in the projection 38. Also, the distal end of the short arm 54 can be provided with a small recess 62 for engagement by a screw driver which can then be used to operate the swivel arm's locking mechanism.

In use. the bracket 10 can receive and hold a conventional head rail 100 for a venetian blind adjacent a window as will now described with reference to FIGS. 4–8. As best seen from FIGS. 4 and 5, the head rail 100 has a bottom web 102, front flange 104 and rear flange 106. An upper end of the front flange. 104 terminates in a front rim 108, and an upper end of the rear flange 106 terminates a in a rear rim 110.

Figure 4:
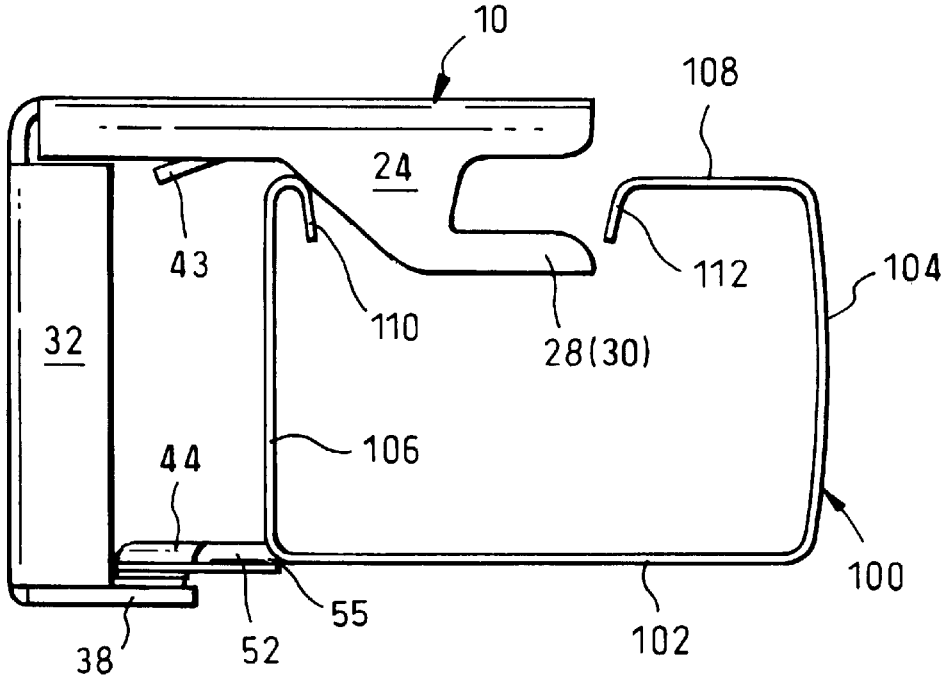
FIG. 4 is a side elevation of the bracket of FIG.1, with a head rail in position for mounting on the bracket.
Figure 5:
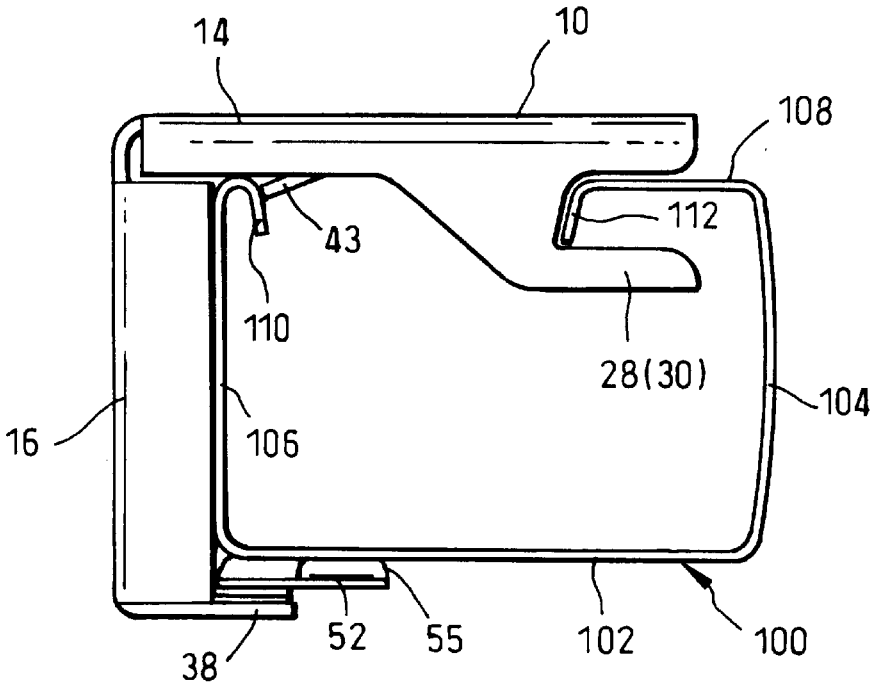
FIG. 5 is a side elevation, similar to FIG. 4, but showing the head rail in position of the bracket just prior to moving the locking member to its second position.
Figure 6:
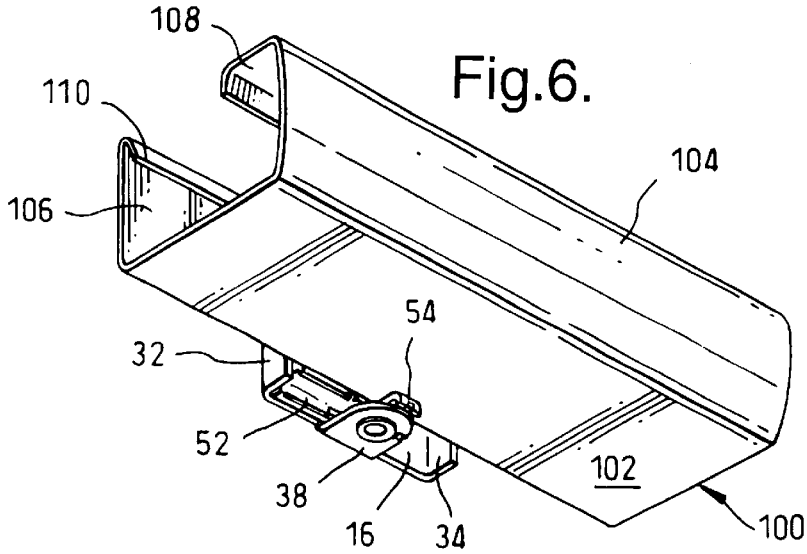
FIG. 6 is a perspective view from below, schematically showing a short piece of head rail in position on a single bracket of FIG. 1, but with its locking member still in its first position.

FIG. 4 shows the relative position of a head rail 100 when it is presented for mounting onto the bracket 10. The front rim 108 with a downwardly turned portion 112 will be moved into a space above the supporting leg 28 and above the supporting leg 30 (hidden from view) of the bracket. At the same time. the bottom web 102 of the head rail will be positioned over the projection 38 and the swivel arm 44 of the bracket, so that the rear rim 110 of the head rail is moved beyond the resilient tongue 43 of the bracket. The resulting position of the head rail, as shown in FIGS. 5 and 6, enables it to be at least temporarily retained on the bracket. In this position, it will also be possible subsequently to move the long arm 52 of the swivel arm 44 of the bracket from its first or open position as shown in FIG. 6 to its second or closed position as shown in FIG. 8 through an intermediate position as shown in FIG. 7.

FIG. 6, it is seen that the long arm 52 of the bracket 10, in its first position, is parallel to the rear wall 16 of bracket and thereby 52 is accommodated between the edge flanges 32 and 34 of the bracket. In this way, the long arm 52 does not interfere, in its first position, with the positioning of the head rail 100 on the bracket.

Figure 7:
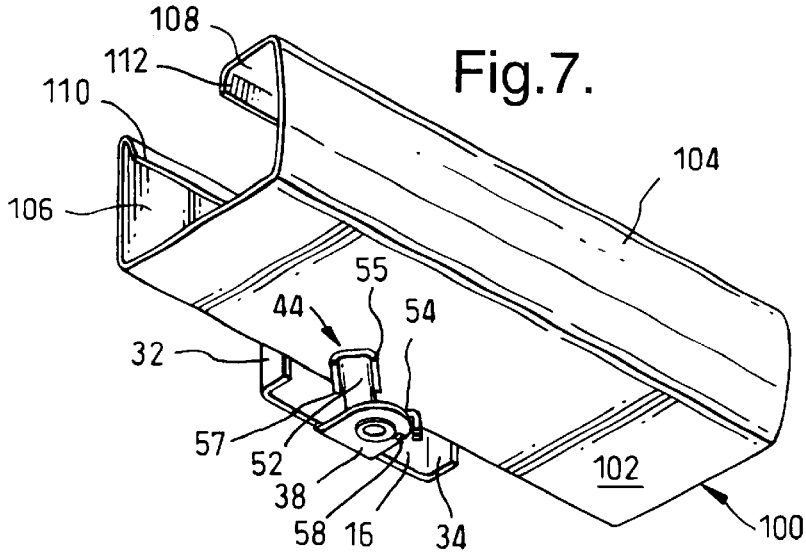
FIG. 7 is a perspective view, similar to FIG. 6. but with the locking member halfway between its first and second positions.
Figure 8:
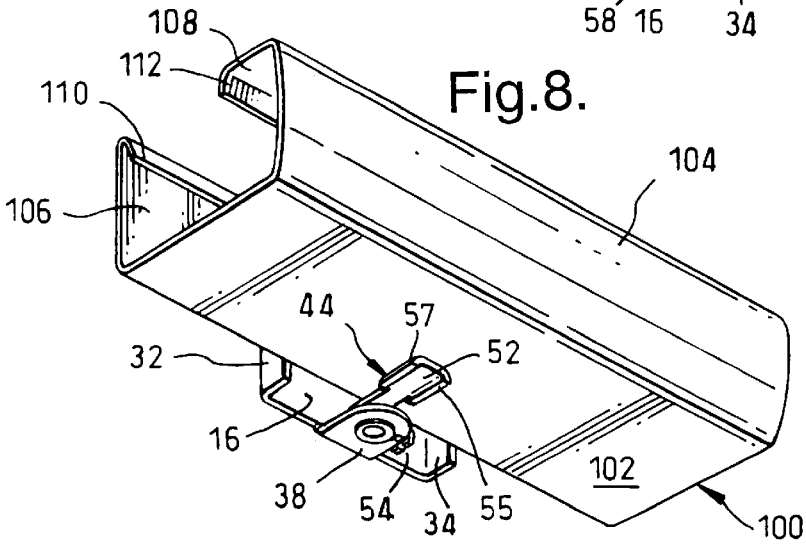
FIG. 8 is a perspective view, similar to FIG. 6 or 7, but with the locking member in its second position.

Thereafter, the head rail can be locked in position by swiveling the long arm 52 of the bracket 10 underneath the bottom web 102 of the head rail 100 as shown in FIGS. 7 and 8. Swiveling of the long arm 52 will be aided by the rounded edge portion 55 on its leading edge, and this will also prevent the long arm 52 from scratching the paint surface of the bottom web 102 of the head rail. From FIGS. 7 and 8, it will be seen that the short arm 54 of the bracket, while eventually abutting the rear wall 16 of the bracket. also engages the rear of the raised detent 58 which will thereby positively latch the swivel arm 44 in the position shown in FIG. 7.

With the head rail 100 in position on the bracket 10, as best seen in FIGS. 5 and 8, it is also desirable for the head rail to be restrained from moving in the longitudinal direction of the head rail. Such movement. which could result in the blind hitting a lateral side of a window recess, is effectively prevented by the resilient press down arms 40, 42. The press down arms urge the sharp edge of the downwardly turned portion 112 of the front rim 108 of the head rail against the relatively sharp and hard edge of the supporting legs 28, 30 of the bracket. Additional restraint on the longitudinal movement of the head rail is provided by the tongue 43 of the bracket which firmly abuts the rear rim of the head rail.

The installation bracket 10 of this invention can receive and hold different head rail shapes which may completely hide from view the top of the bracket. Although it is possible to use a tool, such as a screw driver, to lock or unlock the bracket, this can also be conveniently achieved by directly moving the swivel arm 44 of the bracket with one's finger. Because the way in which the bracket is locked is readily recognizable, the head rail of the blind, mounted on the bracket, can be readily taken down to clean or paint the blind by even unskilled persons. Still, the locking means of the bracket is also sufficiently inconspicuous, so as not to distract form the aesthetic appearance of the window blind. In this regard, most of the projection 38 and the swivel arm 44 of the bracket will be hidden by the top portion or top slat of the blind but will reveal themselves instantly to anyone who wished to remove the head rail and its blind from the bracket.

Another important aspect of the bracket 10 is that it will at least temporarily hold a head rail, even before the swivel arm 44 has been moved from its first position to its second position. This is particularly significant where a long and/or heavy head rail 100 and shade is to be mounted on more than two brackets 10, and therefore, all of the brackets cannot be locked at the same time. This is also true where such a large head rail and window covering has to be removed from a window and not all of the brackets can be unlocked at the same time. The accidental fall of a heavy blind could easily cause injury to persons or property beneath the blind.

This invention is, of course, not limited to the above-described embodiment which may be modified without departing from the scope of the invention or sacrificing all of its advantages. In this regard, the terms in the foregoing description and the following claims, such as "left", "right", "front", "rear", "forward", "upward", "top", "bottom", "horizontal" and "vertical", have been used only as relative terms to describe the relationships of the various elements of the bracket of the invention. For example, the bracket 10 could be used to hold the head rails of other window coverings, besides blinds, as well as other architectural coverings.

What is claimed is:

1. Installation bracket for mounting a head rail of an architectural covering on a wall or ceiling, said bracket having a generally L-shaped main body which can be secured to said wall or ceiling and which comprises a top wall, a rear wall, a forwardly extending, supporting leg on a front end of said top wall for receiving a front rim of said head rail, and a movably mounted locking member, movable between a first position in which said head rail can be positioned or removed from said bracket and a second position in which said head rail is locked on the bracket; said locking member being pivotally mounted on a projection that extends forwardly form said rear wall and is generally parallel to said top wall, and said locking member being adapted to swivel between said first and second positions in a plane substantially parallel to said top wall.

2. The bracket of claim 1 wherein said locking member is adapted to swivel between a first end position and a second end position in a plane substantially parallel to said top wall.

3. The bracket of claim 2 wherein at least one resilient press down arm is positioned to extend downwardly from said top wall and to be resiliently biased towards said supporting leg.

4. The bracket of claim 1 wherein at least one resilient press down arm is positioned to extend downwardly from said top wall and to be resiliently biased towards said supporting leg.

5. The bracket of claim 4 wherein a tongue is positioned on said top wall and extends downwardly and rearwardly therefrom, so as to have a free distal end spaced from said rear wall.

6. The bracket of claim 3 wherein a tongue is positioned on said top wall and extends downwardly and rearwardly therefrom, so as to have a free distal end spaced from said rear wall.

7. The bracket of claim 2 wherein a tongue is positioned on said top wall and extends downwardly and rearwardly therefrom, so as to have a free distal end spaced form said rear wall.

8. The bracket of claim 1 wherein a tongue is positioned on said top wall and extends downwardly and rearwardly therefrom, so as to have a free distal end spaced from said rear wall.

9. The bracket of any one of claims 1–8 wherein said top wall has depending flanges along each of two opposite side edges.

10. The bracket of claim 9 wherein one of said supporting legs is integrally formed on each of said depending flanges.

11. The bracket of claim 9 wherein said rear wall has a forwardly directed, edge flange along each of two opposite vertical side edges.

12. The bracket of claim 11 wherein each of said edge flanges abuts a rear portion of a confronting one of said depending flanges.

13. The bracket of any one of claims 1–8 wherein said locking member includes a central body pivotally connected to said projection and an elongate arm on said central body; said elongate arm having at least one rounded edge portion along at least one of its opposite longitudinal edges, which is the one opposite longitudinal edge that is the leading edge in the direction of swiveling from said first portion to said second position.

14. The bracket of claim 13 wherein said locking member also includes a short arm that extends perpendicularly to said elongate arm from said central body.

15. The bracket of claim 14 wherein said projection includes an upwardly extending raised detent in a path, through which said short arm is adapted to swivel, so as to lock said short arm and said locking member in said second position.

16. The bracket of claim 15 wherein a distal end of said short arm has a recess for engagement by a screwdriver.

17. The bracket of claim 14 wherein a distal end of said short arm has a recess for engagement by a screwdriver.

* * * * *